US010182689B2

(12) United States Patent
Michikoshi et al.

(10) Patent No.: US 10,182,689 B2
(45) Date of Patent: Jan. 22, 2019

(54) SQUEEGEE DEVICE FOR CLEANING

(71) Applicant: Nihon Bisoh Co., Ltd, Tokyo (JP)

(72) Inventors: Masahiro Michikoshi, Tokyo (JP); Takeo Yamazaki, Tokyo (JP)

(73) Assignee: NIHON BISOH CO., LTD., Tokyo (JP)

( * ) Notice: Subject to any disclaimer, the term of this patent is extended or adjusted under 35 U.S.C. 154(b) by 0 days.

(21) Appl. No.: 15/572,544

(22) PCT Filed: May 19, 2016

(86) PCT No.: PCT/JP2016/064823

§ 371 (c)(1),
(2) Date: Nov. 8, 2017

(87) PCT Pub. No.: WO2016/186156

PCT Pub. Date: Nov. 24, 2016

(65) Prior Publication Data

US 2018/0125311 A1 May 10, 2018

(30) Foreign Application Priority Data

May 20, 2015 (JP) ..... 2015-102641

(51) Int. Cl.

| | |
|---|---|
| ***A47L 1/08*** | (2006.01) |
| ***A47L 1/02*** | (2006.01) |
| ***A47L 11/40*** | (2006.01) |
| ***E04G 23/00*** | (2006.01) |

(52) U.S. Cl.

CPC ..... *A47L 1/02* (2013.01); *A47L 1/08* (2013.01); *A47L 11/4016* (2013.01); *A47L 11/4044* (2013.01); *A47L 11/4052* (2013.01); *E04G 23/00* (2013.01)

(58) Field of Classification Search

CPC ..... A47L 1/02; A47L 1/08; A47L 11/4016; A47L 11/4044; A47L 11/4052; E04G 23/00

See application file for complete search history.

(56) References Cited

U.S. PATENT DOCUMENTS 4,817,233 A * 4/1989 Waldhauser ..... A47L 11/30 15/320
2018/0116476 A1* 5/2018 Bloemendaal ..... A47L 11/30

FOREIGN PATENT DOCUMENTS

| | | |
|---|---|---|
| JP | S57-190530 | 11/1982 |
| JP | 2000-342491 | 12/2000 |
| JP | 2008-099818 | 5/2008 |

OTHER PUBLICATIONS

ISR and Written Opinion, JPO, dated Aug. 2, 2016.

* cited by examiner

*Primary Examiner* — Shay Karls
(74) *Attorney, Agent, or Firm* — Florek & Endres PLLC

(57) ABSTRACT

A squeegee device (10) for cleaning includes a main supporting base (20) in which an opening (24) is formed along a cleaning width direction of a cleaning surface (W), and a pair of squeegees (30) and (40) arranged to extend along the cleaning width direction along the periphery of the opening (24) and formed of an elastic body. Tips of the pair of squeegees (30, 40) are arranged at an angle relative to each other and contact each other in an airtight state, and pressing the tips against the cleaning surface (W) can open a gap between the tips.

4 Claims, 6 Drawing Sheets

SQUEEGEE DEVICE FOR CLEANING

TECHNICAL FIELD

The present disclosure relates to a squeegee device for cleaning.

BACKGROUND ART

Squeegee devices for cleaning are used as tools for cleaning wall surfaces and glass windows of buildings. Conventional squeegee devices for cleaning include a wiping squeegee and a receiving squeegee as a two-squeegee mechanism, a sprinkling mechanism, and a collection mechanism for contaminated water and the like. The conventional squeegee devices for cleaning sprinkle water, wipe off dirt and collect contaminated water. For example, a squeegee device for cleaning that is a cleaning head of an automatic wall surface cleaning device mainly includes combinations of two mechanisms, that is, "a wiping squeegee and a water sprinkling mechanism", and "a receiving squeegee and a collection mechanism for contaminated water and the like". A driving mechanism for extension and contraction (approaching to or separating from a wall surface) and an undulating driving mechanism are disposed in the wiping squeegee and the water sprinkling mechanism, and a driving mechanism for extension and contraction (approaching to or separating from a wall surface) is disposed in the receiving squeegee and the collection mechanism for contaminated water and the like (refer to Patent Literature 1).

CITATION LIST

Patent Literature

Patent Literature 1: Unexamined Japanese Patent Application Kokai Publication No. 2008-99818.

SUMMARY OF INVENTION

Technical Problem

In a squeegee for cleaning of a conventional automatic wall surface cleaning device, each of the wiping and receiving squeegees includes a drive mechanism. The wiping squeegee is extended and contracted and undulated by the driving mechanism thereof, and the receiving squeegee is extended and contracted by the driving mechanism thereof. The including of multiple mechanisms is problematic in that weight increases, and weight reduction and size reduction cannot be achieved. In addition, control of each driving mechanism is required to automate a wall surface cleaning, leading to a problem that controlling mechanisms become complicated.

The present disclosure is made in consideration of the problems of the above-mentioned conventional techniques. Thus the objective of the present disclosure is to provide a squeegee device for cleaning that can reduce size and weight of the device by simplifying the driving mechanism.

Solution to Problem

To achieve the above-mentioned objective, the squeegee device for cleaning according to the present invention is characterized by including: a main supporting base in which an opening is formed along a cleaning width direction of a cleaning surface, the main supporting base being moved along the cleaning width direction; and a pair of squeegees formed of elastic bodies having a same shape symmetrically arranged across a center face of the opening on both sides of the opening in the main supporting base, tips of the pair of squeegees being arranged at an angle relative to each other, and configured to contact hermetically to form a closed space, the pair of squeegees being fixed to the main supporting base to extend along the cleaning width direction such that the gap between the tips being formable by approaching and pressing of the tips against the cleaning surface, wherein the pair of squeegees are disposed in the main supporting base forming a receiving squeegee on the front side in the cleaning direction crossing the cleaning width direction and a wiping squeegee on the rear side, and cleans the cleaning surface by approaching and pressing to the cleaning surface and moving in the cleaning direction or in a reverse direction of the cleaning direction.

The main supporting base including a sprinkling mechanism, wherein the sprinkling mechanism has a sprinkling pipe in which two rows of sprinkling holes are formed along the cleaning width direction is arranged in the main supporting base, and sprinkles from any one row of the sprinkling holes from the two rows of sprinkling holes towards the cleaning surface from the gap between the tips of the pair of squeegees is disposed in the main supporting base in the cleaning direction or in a reverse direction of the cleaning direction.

In the main supporting base, a collection mechanism may be disposed that communicates with the closed space and collects cleaning resultants from the closed space.

An inner side face of the closed space of the wiping squeegee may be set at a contact angle of 90 degrees or less with respect to the cleaning surface in the cleaning direction or in a reverse direction of the cleaning direction.

Advantageous Effects of Invention

The present disclosure enables reduction of size and weight by simplifying the driving mechanism.

DESCRIPTION OF EMBODIMENTS

Figure 1:
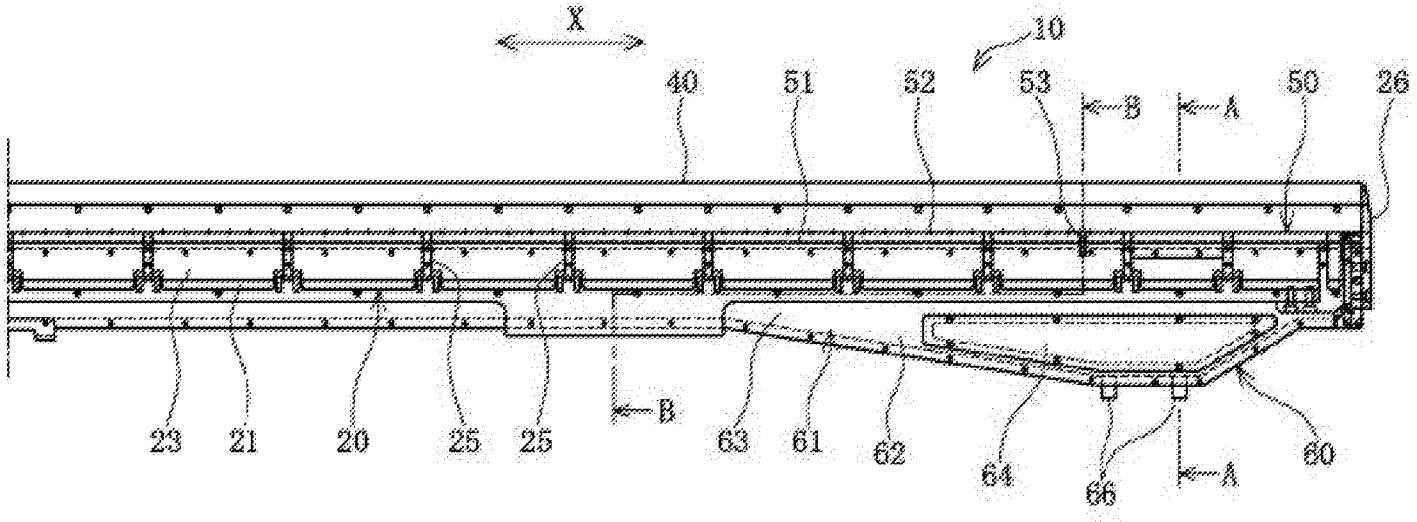
FIG. 1 is a planar view in which a left half and an upper portion of the squeegee of the squeegee device for cleaning according to an embodiment of the present disclosure are omitted.
Figure 2A:
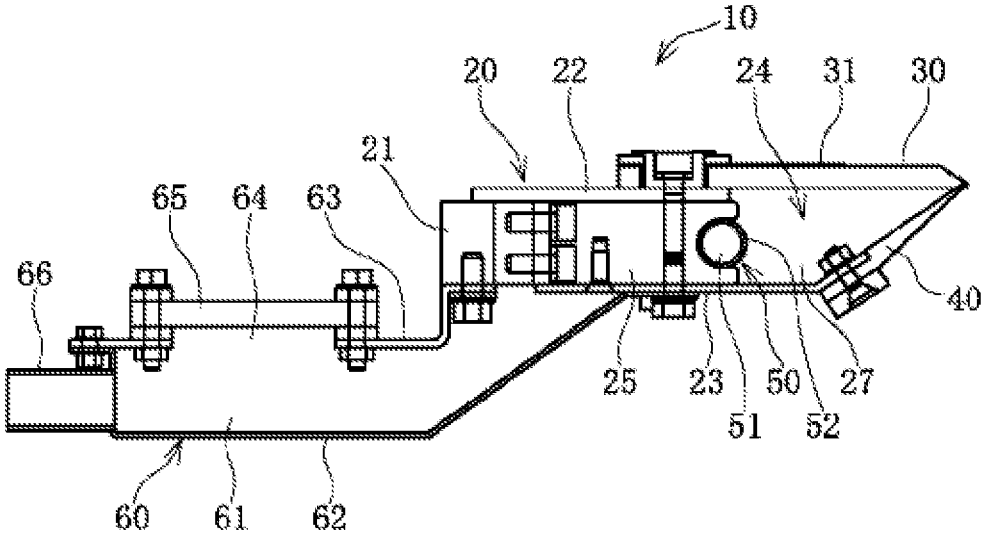
FIG. 2A is a cross-sectional view along the A-A line of FIG. 1 showing the squeegee device for cleaning according to an embodiment of the present disclosure.
Figure 2B:
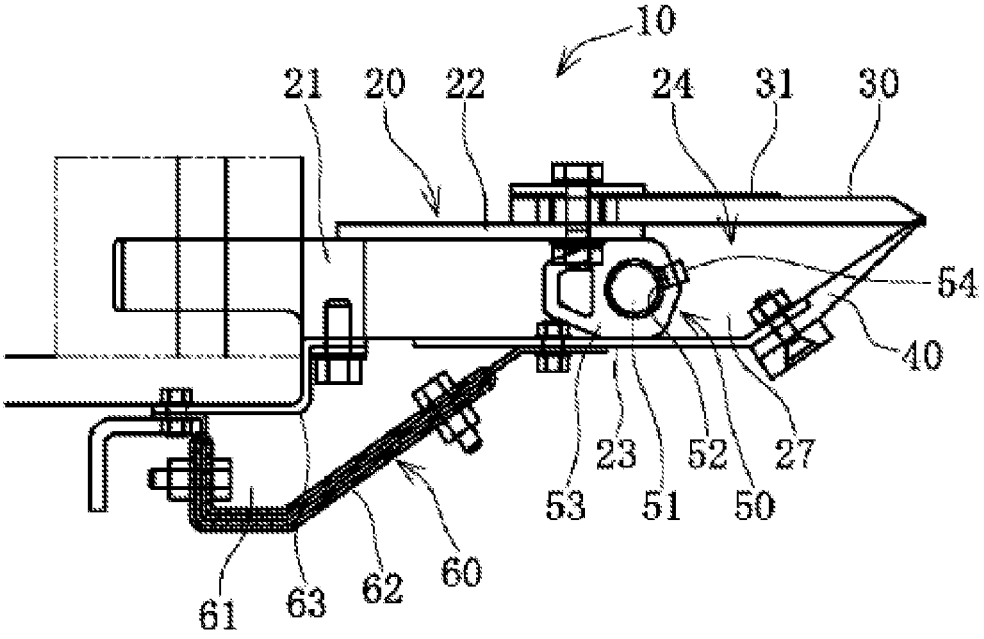
FIG. 2B is a cross-sectional view along the B-B line of FIG. 1 showing the squeegee device for cleaning according to an embodiment of the present disclosure.

Hereinafter, an embodiment of a squeegee device for cleaning according to the present disclosure is described in detail with reference to drawings.

A squeegee device 10 for cleaning is, for example, used as a cleaning head of an automatic cleaning device that cleans the windowpanes of buildings. The squeegee device 10 for cleaning is mounted on a body of an automatic cleaning device that is hoisted up and down along a wire rope hung from a roof terrace of a building. The squeegee device 10 for cleaning is used for cleaning windowpanes while lowering the body of the automatic cleaning device. The cleaning direction of the squeegee device 10 for cleaning with respect to the windowpanes is not limited to a lowering direction in which the windowpanes are cleaned from the top to the bottom. Cleaning directions may be a horizontal direction from left to right or from right to left.

The squeegee device 10 for cleaning includes a main supporting base 20 in which an opening 24 is formed along a cleaning width direction X of a cleaning surface W, and a pair of squeegees 30 and 40 that are disposed on both sides of the opening 24 and are fixed to the main supporting base 20, extend along the cleaning width direction X, and are formed by an elastic body. The pair of squeegees 30 and 40 is disposed with the tips thereof making an angle, and the tips are contacted in an airtight state. A space is opened between the tips by the pair of squeegees 30 and 40 approaching the cleaning surface W and being pressed.

The squeegees 30 and 40 of the squeegee device 10 for cleaning are disposed in a horizontal direction which is a direction that is the same as the cleaning width direction X. The squeegees 30 and 40 are pressed to a windowpane which is the cleaning surface W, an upper side squeegee 30 functions as a wiping squeegee, a lower side squeegee 40 is functions as a receiving squeegee, and the squeegees 30 and 40 move from the top towards the bottom of the windowpane in a cleaning direction Y. While moving from the top towards the bottom of the windowpane, the squeegee device 10 for cleaning including the squeegees 30 and 40 cleans the windowpane. Assuming cleaning in the left-and-right direction, arrangements and angles of the squeegees 30 and 40 are described below with reference to FIG. 5.

The main supporting base 20 includes a base frame 21 along the cleaning width direction X of the cleaning surface W, and has a length approximately the same as the cleaning width.

Base boards 22 and 23 for attaching the squeegees 30 and 40 are mounted on the upper and the lower sides of the base frame 21. The base boards 22 and 23 are mounted sticking out to the cleaning surface W side, and the cross section is approximately U-shaped. Thus in the main supporting base 20, the opening 24 is formed in the cleaning width direction X of the cleaning surface W by the base frame 21 and the upper and the lower side base boards 22 and 23.

Reinforcing rib frames 25 are equally spaced and disposed between the upper and the lower side base boards 22 and 23 inside the base frame 21 along the cleaning width direction X, securing the gap between the upper and lower base boards 22 and 23.

The upper and lower base boards 22 and 23 are members for attaching the squeegees 30 and 40. The squeegee 30 fixed to the upper base board 22 and the squeegee 40 fixed to a lower base board 23 are arranged at a predetermined angle so that the tip of the squeegee 30 and the tip of the squeegee 40 contact in an airtight state. For example, an angle made by the upper base board 22 and the lower base board 23 is set to approximately 30 through 60 degrees, and only the tip of the lower base board 23 is bent upward.

Because the squeegee device 10 for cleaning cleans while being lowered, the upper base board 22 on the rear side in the cleaning direction is arranged approximately horizontal (90 degrees or less with respect to the cleaning surface). The tip of the lower base board 23 on the front side in the cleaning direction is bent upward, and the angle made by the upper base board 22 and the lower base board 23 is set to approximately 30 through 60 degrees.

The base frame 21 and the upper and the lower side base boards 22 and 23 form an approximate U shape in a cross section of the main supporting base 20. Right and left ends of the main supporting base 20 are blocked by side plates 26, thereby forming a closed space 27.

The squeegee 30 and the squeegee 40 are formed of elastic bodies such as rubber. The squeegee 30 and the squeegee 40 are plate-like members having lengths corresponding to the cleaning width. Flat surfaces are formed on the insides of the tips, and inclined surfaces are formed on the outside of the tips to make the tips sharply tapered. The squeegee 30 and the squeegee 40 are disposed on both sides (here, upper and lower sides) of the opening 24 of the main supporting base 20.

A reinforcement board 31 is attached to the squeegee 30. The reinforcement board 31 extends from a position at which the upper surface of the squeegee 30 is fixed to the base board 22 up to a middle point of the horizontal length of the squeegee 30 perpendicular to the cleaning width direction X. Wiping can be performed by the reinforcement board 31 pressing the squeegee 30 and stabilizing an elastic reaction force generated when the squeegee 30 is pressed to the cleaning surface W.

The squeegee 40 is fixed to the bent portion of the lower base board 23. The tip of the squeegee 40 contacts the tip of the squeegee 30 at an angle, and forms an airtight state.

In a state prior to pressing against the cleaning surface W, the squeegee 30 and the squeegee 40 can maintain an airtight state with the tips contacting each other. In the state of being pressed against the cleaning surface W, a space forms between the squeegee 30 and the squeegee 40. The width of the opened space between the squeegee 30 and the squeegee 40 varies depending on the shapes of the tips of the squeegee 30 and the squeegee 40, an elastic force of the rubber and the like. For example, the opening width is set to be around 10 mm when a pressing margin to the cleaning surface W is assumed be around 3 mm.

The side plates 26 disposed at right and left ends of the main supporting base 20 are dimensioned so as to extend up to 5 mm short of the tips of the squeegee 30 and the squeegee 40. This keeps a pressing amount within a certain range when the squeegee 30 and the squeegee 40 are pressed against the cleaning surface W, and prevents excessive pressing against the cleaning surface W.

The opening 24 is formed in the main supporting base 20 of the squeegee device 10 for cleaning along the cleaning width direction X of the cleaning surface W, and the squeegee 30 and the squeegee 40 formed of a pair of elastic bodies are disposed and fixed on both sides (upper and lower sides) of the opening 24. The pair of the squeegees 30 and 40 are arranged to make an angle, and the tips thereof contact in an airtight state. The pair of the squeegees 30 and 40 approach and is pressed against the cleaning surface W, and a space is formed between the tips thereof. The squeegee 30 functions as an upper side wiping squeegee elastically deformed in an arc by being pressed after the squeegee device 10 for cleaning is contacted against a windowpane that is the cleaning surface W. The inside corner of the squeegee 30 contacts the cleaning surface W, and by maintaining this state and being moved down, the corner can scrape off the cleaning resultants such as the filthy matter adhering to the cleaning surface W and the like.

The cleaning resultants scraped off by the upper side squeegee 30 are collected from an opening formed between the upper side and lower side squeegees 30 and 40 into the closed space 27 along the squeegee 40 that functions as the lower side receiving squeegee whose tip contacts the cleaning surface W.

After the lower end of the windowpane that is the cleaning surface W is cleaned, the squeegee device 10 for cleaning is separated and pulled away from the windowpane that is the cleaning surface W, and warped portions of the tips of the upper and lower squeegees 30 and 40 return to the original state in which the tips contact each other by the elastic force. Therefore, the cleaning resultants collected into the closed space 27 are retained without leaking out.

Sprinkling, air blowing and/or the like can be performed by utilizing the opening formed between the upper and lower squeegees 30 and 40. Thus, cleanliness can be much more improved by removing unwiped matters and draining.

Such a squeegee device 10 for cleaning, in which all functions such as sprinkling, wiping, contaminated water collection and the like are integrated, can be used by attachment to a cleaning head of an automatic cleaning device, as a tip tool (end effect) of a robot for cleaning, and by use as a hand tool by a worker. The squeegee device 10 for cleaning can clean while moving and being pressed against the cleaning surface W, no upward/downward movement operation is required, and the cleaning work can be finished by pulling away from the cleaning surface W.

A sprinkling mechanism 50 in the squeegee device 10 for cleaning is disposed to sprinkle water towards the cleaning surface W. The sprinkling mechanism 50 sprinkles water towards the cleaning surface W from the gap opened by pressing the upper and lower squeegees 30 and 40 against the cleaning surface W. The sprinkling mechanism 50 includes a sprinkling pipe 51 and sprinkling holes 52. The sprinkling pipe 51 is disposed on the front side (the cleaning surface W side) of the base frame 21 of the main supporting base 20 along the cleaning width direction X. The sprinkling holes 52 are formed in the sprinkling pipe 51 at a predetermined spacing. The sprinkling pipe 51 is attached to the rib frames by insertion in the U shaped supporting portion formed at a tip of the rib frames 25. Angle setting blocks 53 are fitted to two middle portions of the sprinkling pipe 51. The angle setting blocks 53 are disposed to surround the sprinkling pipe 51 and are fixed in the main supporting base 20. The sprinkling pipe 51 mounted in the angle setting blocks 53 is rotated around the center axis of the sprinkling pipe 51 and is fastened using a set screw 54 from the outer circumference side of the angle setting blocks 53. With respect to a horizontal direction, the direction of the sprinkling holes 52 is set to make angles, for example, about 15 through 20 degrees upward. In this way, the angles of the sprinkling holes 52 can be set towards the opening formed by the pair of squeegees 30 and 40 that is positioned about 15 through 20 degrees upward with respect to the horizontal direction.

At an end of the sprinkling pipe 51, a quick connect-disconnect type pipe fitting is connected via a joint disposed at the end, and pressurized cleaning water can be supplied from a cleaning water supply device (not illustrated) to the sprinkling pipe 51.

In the squeegee device 10 for cleaning, a collection mechanism 60 is disposed that collects cleaning resultants such as filthy matter, contaminated water and the like generated by the cleaning.

The collection mechanism 60 includes a container 61. The container 61 is a closed space that contains cleaning resultants such as collected contaminated water and the like. The container 61 communicates with the closed space 27 formed in the main supporting base 20, and is fixed to the main supporting base 20 in such a way that the container 61 sticks out to the rear lower portion of the closed space 27. The container 61 includes a lower collection receiving member 62 that contains collected cleaning resultants and a collection receiving base board 63 that causes the main supporting base 20 to support the collection receiving member 62, and that covers the upper portion of the collection receiving member 62 to form the closed space. The collection receiving member 62 is disposed to form a gutter shape in the rear lower portion of the base frame 21 that is disposed corresponding to the length of the cleaning width. A maintenance hole portion 64 that greatly sticks out in the rear in the approximately horizontal direction is formed at both ends of the collection receiving member 62. The maintenance hole portion 64 includes an opened hole, and the opened hole is covered by a transparent maintenance hole cover 65. The status of collection of the cleaning resultants can be visually viewed through the maintenance hole portion 64 covered by the maintenance cover 65.

A pipe joint 66 is connected to a rear wall of the maintenance hole portion 64. Through the pipe joint 66, the cleaning resultants can be collected outside from the container 61 in a natural fall difference, or can be sucked by a forced suction device such as pumps (not illustrated) and collected outside. The collected contaminated water is purified through a filter, and recycled.

Due to disposal of the sprinkling mechanism 50 and the collection mechanism 60 in the squeegee device 10 for cleaning, water can be sprinkled on the cleaning surface W and the contaminated water together with filthy matter can be collected.

An opening is formed by the upper and lower squeegees 30 and 40 being pressed to the windowpane which is the cleaning surface W. From this opening, cleaning water is sprinkled through the large number of sprinkling holes 52 formed in the sprinkling pipe 51 of the sprinkling mechanism 50. Simultaneously with the sprinkling of water, cleaning is performed by using the upper side wiping squeegee 30 to wipe off the dirt and sprinkled water. The contaminated water generated by the cleaning is received by the lower side receiving squeegee 40, and is collected in the container 61 of the collection mechanism 60 through the closed space 27 of the main supporting base 20. The cleaning resultants such as the contaminated water collected in the container 61 are discharged outside the squeegee device 10 for cleaning through the pipe joint 66. After waste water treatment, the cleaning resultants are disposed, or are recycled by purification such as by filtration.

Cleaning can be much more assured by water sprinkling and then cleaning. Cleaning can be performed by collecting cleaning resultants such as contaminated water and the like, thereby enabling avoidance of effects such as scattering of the cleaning resultants into the surroundings.

Next, a cleaning direction of the squeegee device 10 for cleaning and arrangement and angles of the two squeegees 30 and 40 are described with reference to FIGS. 5 and 6.

1) Roles of the Two Squeegees 30 and 40

For the two squeegees 30 and 40, the squeegee varies between functioning as a receiving squeegee or a wiping squeegee, depending on the cleaning direction.

In other words, one squeegee at the front side of the cleaning direction is configured as a receiving squeegee and the other squeegee at the rear side is configured as a wiping squeegee.

The above described embodiment is a case when the cleaning is performed while the squeegees is lowered from the top to the bottom of the windowpane in the cleaning direction Y. The squeegee 40 on the front side (lower side) of the cleaning direction is configured as a receiving squeegee, and the squeegee 30 on the rear side (upper side) is configured as a wiping squeegee.

Figure 5A:
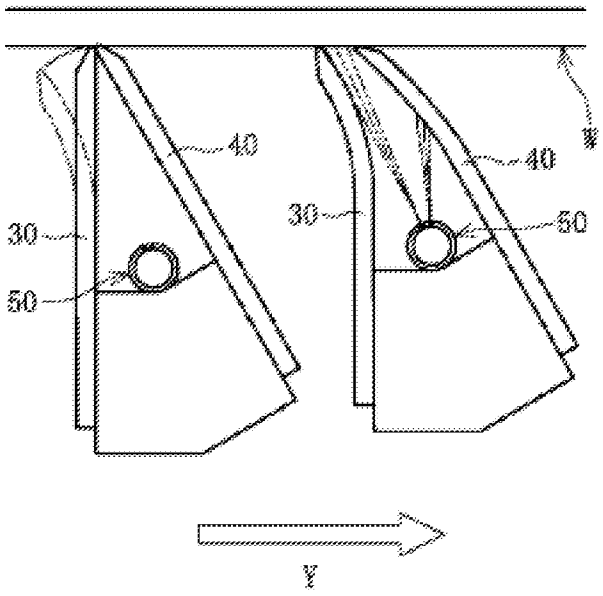
FIG. 5A is a drawing for description of functions of a pair of squeegees when a squeegee device for cleaning according to an embodiment of the present disclosure is used to clean from the left direction to the right direction.

When the cleaning direction is assumed to be the right and left direction, as shown in FIG. 5, the pair of squeegees 30 and 40 is disposed along an up-and-down direction. When the cleaning is performed while moving from left to right, the squeegee 40 on the front side (right side) of the cleaning direction is configured as a receiving squeegee, and the squeegee 30 on the rear side (left side) is configured as a wiping squeegee (refer to FIG. 5A).

Figure 5B:
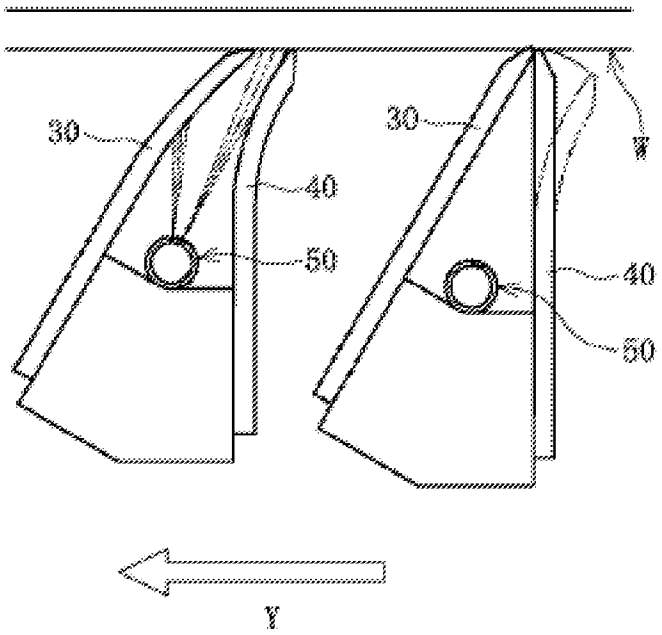
FIG. 5B is a drawing for description of functions of a pair of squeegees when the squeegee device for cleaning according to an embodiment of the present disclosure is used to clean from the right direction to the left direction.

Conversely, when the cleaning is performed while moving from left to right, the squeegee 40 on the front side (left side) of the cleaning direction is configured as a receiving squeegee, and the squeegee 30 on the rear side (right side) is configured as a wiping squeegee (refer to FIG. 5B).

The operations such as wiping and collection of cleaning resultants such as contaminated water and the like do not change in accordance with changes of the wiping squeegee and the receiving squeegee due to the cleaning direction.

2) Contact Angle of the Wiping Squeegee 30 Against the Cleaning Surface W

Figure 6:
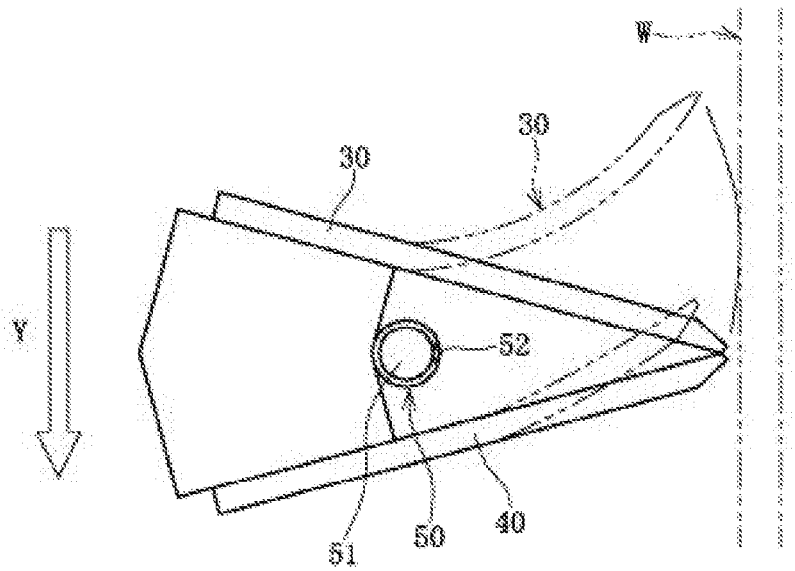
FIG. 6 is drawing for description of a contact angle with respect to a wall surface of the pair of squeegees when the squeegee device for cleaning according to an embodiment of the present disclosure is used to clean in the vertical direction.

For example, as shown in FIG. 6, when the cleaning direction is assumed to be from up to down, the wiping squeegee 30 contacts the cleaning surface W at an obtuse angle. When the wiping squeegee 30 is separated from the cleaning surface W at the end of the cleaning, a return trajectory during return of the tip of the squeegee 30 from a flexed state to the original state passes beyond the apex of the arc. Therefore, the tip of the squeegee 30 does not contact to the cleaning surface W at the time when the tip of the squeegee 30 passes beyond the apex. Thus, at the time when the squeegee 30 passes beyond the apex of the return trajectory, a phenomenon occurs in which the squeegee 30 bounces back, and the cleaning surface W cannot be completely wiped and/or drained.

For that reason, at least the apex of the return trajectory of the squeegee 30 and the finish wiping point of the squeegee 30 are required to be placed at the same position. The contact angle between the cleaning surface W and the wiping squeegee 30 on the rear side in the cleaning direction when pressed is required to be 90 degrees or less.

In this way, the tip of the wiping squeegee 30 can maintain contact between the wiping squeegee 30 and the cleaning surface W up to the wiping finish time, and can perform complete wiping and drainage.

The contact angle between the wiping squeegee 30 and the cleaning surface W is independent of the cleaning direction. The contact angle between a squeegee that functions as a rear squeegee in the cleaning direction and the cleaning surface may be set to 90 degrees or less.

Figure 3:
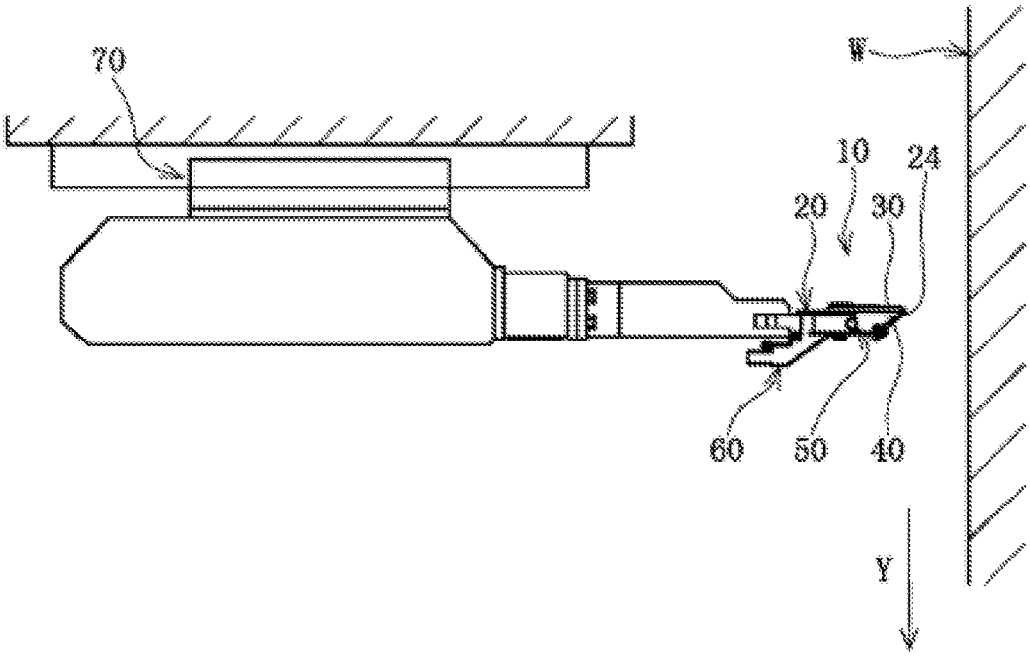
FIG. 3 is a schematic side view in which a squeegee device for cleaning according to an embodiment of the present disclosure is applied to an automatic wall surface cleaning device.
Figure 4:
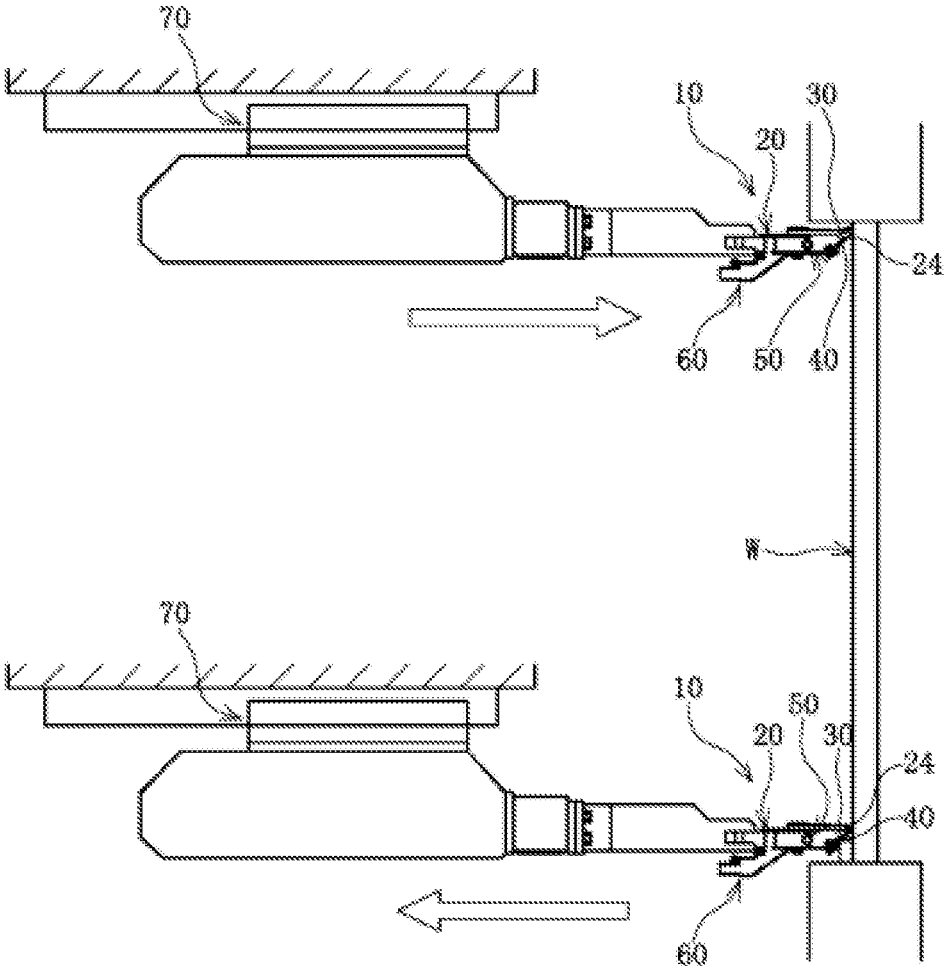
FIG. 4 is a schematic side view in which a squeegee device for cleaning according to an embodiment of the present disclosure is applied to an automatic wall surface cleaning device in a cleaning state.

When the squeegee device 10 for cleaning is used as a cleaning head of an automatic wall surface cleaning device, as shown in FIGS. 3 and 4, the squeegee device for cleaning is installed via a reciprocating drive mechanism 70 that approaches and separates from the cleaning surface W. The squeegee device 10 for cleaning maintains a state of being pressed to the cleaning surface W and is moved in the cleaning direction to thereby perform cleaning.

When the squeegee device 10 for cleaning is used as an end effect such as that of a robot for cleaning, the squeegee device 10 for cleaning maintains a state of being pressed to the cleaning surface W, is moved in a predetermined cleaning direction, and thereby performs cleaning.

When a worker holds the squeegee device 10 for cleaning in a hand as a hand tool and cleans, the worker presses the squeegee device 10 for cleaning against the cleaning surface W, maintains the pressed state, and moves the squeegee device 10 for cleaning in the predetermined cleaning direction to thereby perform cleaning.

In either case, the cleaning is finished by separating the squeegee device 10 for cleaning from the cleaning surface W.

Therefore, the upward/downward movement operation required upon finishing wiping of the conventional squeegee devices is not required, no upward/downward movement mechanism is required, and size and weight reductions of the device can be achieved.

As specifically described in the present Embodiment, the squeegee device 10 for cleaning of the present disclosure includes the main supporting base 20 in which the opening 24 is formed along the cleaning width direction X of the cleaning surface W, wherein the squeegee 30 and the squeegee 40 formed of a pair of elastic bodies are disposed on both sides (upper and lower sides) of the opening 24 and are fixed to the main supporting base 20. The pair of squeegees 30 and 40 is arranged to make an angle, and the tips of the squeegees contact in an airtight state. The gap between the tips of the squeegees can be made by the pair of squeegees 30 and 40 approaching and being pressed against the cleaning surface W. In this way, after the squeegee device 10 for cleaning contacts the windowpane that is the cleaning surface W and is pressed, the squeegee 30 that is an upper side wiping squeegee is elastically deformed in an arc, and the inside corner thereof contacts the cleaning surface W. By maintaining this state and being moved downward, the corner can scrape off the cleaning resultants such as the filthy matter adhering to the cleaning surface W and the like.

The cleaning resultants scraped off at the upper side squeegee 30 can be collected from the opening formed between the upper and lower squeegees 30 and 40 along the squeegee 40, which is the lower side receiving squeegee whose tip contacts the cleaning surface W, into the closed space 27.

The warped portions of the tips of the upper and lower squeegees 30 and 40 return to the original positions due to the elastic force and the tips are in the contacted state by moving the squeegee device 10 for cleaning away from the windowpane which is the cleaning surface W after having cleaned to the lower end of the windowpane which is the cleaning surface W. In this way, the cleaning resultants collected into the closed space 27 can be retained without leaking out.

Since sprinkling, air blowing and/or the like can be performed by utilizing the opening formed between the upper and lower squeegees 30 and 40, cleanliness can be much more improved by removing unwiped matter and draining.

In a conventional method, since the pair of squeegees 30 and 40 functioning as a wiping squeegee and a receiving squeegee are separately configured and the squeegees are driven by separate driving mechanisms, applications of the conventional method to hand tools is difficult. In the squeegee device 10 for cleaning of the present disclosure, because the pair of squeegees 30 and 40 is integrated and the operation to the cleaning surface W is limited to only an approach and moving away operation, size and weight reductions of the device can be achieved, and the range of application of the squeegee device 10 for cleaning can be greatly increased.

According to the squeegee device 10 for cleaning, because the tips of the squeegees 30 and 40 are contacted in an airtight state to form the closed space 27, the main supporting base 20 can retain the cleaning resultants, collected at the front squeegee in the cleaning direction, in the closed space 27.

According to the squeegee device 10 for cleaning, the main supporting base 20 includes the sprinkling mechanism 50 sprinkling towards the cleaning surface W from the gap between the pair of squeegees 30 and 40. Therefore, the sprinkling can still more surely clean the cleaning surface W and can improve the cleanliness. The contaminated water and the like after the cleaning can be collected into the closed space 27 formed by the main supporting base 20 and the pair of the squeegees 30 and 40.

According to the squeegee device 10 for cleaning, since the main supporting base 20 communicates with the closed space 27 and includes the collection mechanism 60 collecting the cleaning resultants from the inside of the closed space 27, the squeegee device 10 can collect the cleaning resultants from the inside of the closed space 27 to outside using the collection mechanism 60. In this way, Regardless of sizes of the closed space 27, cleaning works can be continuously performed.

According to the squeegee device 10 for cleaning, in the pair of squeegees 30 and 40, the front side squeegee of the cleaning direction crossing the cleaning width direction is assumed to be a receiving squeegee, and the rear side squeegee is assumed to be a wiping squeegee. Because the wiping squeegee is disposed with the contact angle set to 90 degrees or less with respect to the cleaning surface W, the cleaning surface W can be cleaned by the wiping squeegee, the receiving squeegee can receive the cleaning resultants such as filthy matter and the like, and the cleaning resultants can be collected. Since the wiping squeegee is arranged having the contact angle set to 90 degrees or less with respect to the cleaning surface W, and since the cleaning can be performed with the wiping squeegee contact the cleaning surface W from the beginning until the end of wiping, the cleaning can be performed without the occurrence of unwiped matter.

The present disclosure can be embodied in various ways and can undergo various modifications without departing from the broad spirit and scope of the disclosure. Moreover, the embodiment described above is for explaining the present disclosure, and does not limit the scope of the present disclosure. In other words, the scope of the present disclosure is as set forth in the Claims and not the embodiment. Various changes and modifications that are within the scope disclosed in the claims or that are within a scope that is equivalent to the claims of the disclosure are also included within the scope of the present disclosure.

The present application is based on Japanese Patent Application No. 2015-102641, filed on May 20, 2015. The entire specification, scope of the claims and drawings of Japanese Patent Application No. 2015-102641 are incorporated in the present disclosure by reference.

REFERENCE SIGNS LIST

10 Squeegee device for cleaning
20 Main supporting base
21 Base frame
22 Upper base board
23 Lower base board
24 Opening
25 Rib frame
26 Side plate
27 Closed space
30 Squeegee
31 Reinforcement board
40 Squeegee
50 Sprinkling mechanism
51 Sprinkling pipe
52 Sprinkling hole
53 Angle setting block
54 Set screw
60 Collection mechanism
61 Storage space
62 Collection receiving member
63 Collection receiving base board
64 Maintenance hole
65 Maintenance hole cover
66 Pipe joint
70 Reciprocating drive mechanism
W Cleaning surface
X Cleaning width direction
Y Cleaning direction

The invention claimed is:

1. A squeegee device for cleaning, comprising:

a main supporting base in which an opening is formed along a cleaning width direction of a cleaning surface, the main supporting base being moved along the cleaning width direction; and a pair of squeegees formed of elastic bodies having a same shape symmetrically arranged across a center face of the opening on both sides of the opening in the main supporting base, tips of the pair of squeegees being arranged at an angle relative to each other, and are configured to contact hermetically to form a closed space, the pair of squeegees being fixed to the main supporting base to extend along the cleaning width direction such that a gap between the tips being formable by approaching and pressing of the tips against the cleaning surface, wherein the pair of squeegees are disposed in the main supporting base forming a receiving squeegee on the front side in the cleaning direction crossing the cleaning width direction and a wiping squeegee on the rear side, and cleans the cleaning surface by approaching and pressing to the cleaning surface and moving in the cleaning direction or in a reverse direction of the cleaning direction.

2. The squeegee device for cleaning according to claim 1, the main supporting base including a sprinkling mechanism, wherein the sprinkling mechanism has a sprinkling pipe in which two rows of sprinkling holes are formed along the cleaning width direction is arranged in the main supporting base, and sprinkles from any one row of the sprinkling holes from the two rows of sprinkling holes towards the cleaning surface from the gap between the tips of the pair of squeegees is disposed in the main supporting base in the cleaning direction or in a reverse direction of the cleaning direction.

3. The squeegee device for cleaning according to claim 1, wherein a collection mechanism communicating with the closed space and configured to collect the cleaning resultants from the closed space is disposed in the main supporting base.

4. The squeegee device for cleaning according to claim 1, wherein, an inner side face of the closed space of the wiping squeegee is set at a contact angle of 90 degrees or less with respect to the cleaning surface in the cleaning direction or in a reverse direction of the cleaning direction.

* * * * *